US006523620B1

(12) United States Patent
Burson

(10) Patent No.: US 6,523,620 B1
(45) Date of Patent: Feb. 25, 2003

(54) MOVABLE BLADE FOR MATERIAL MOVING MACHINES

(76) Inventor: Bruce Burson, 17272 Summers Dr., Tehachapi, CA (US) 93561

( * ) Notice: Subject to any disclaimer, the term of this patent is extended or adjusted under 35 U.S.C. 154(b) by 0 days.

(21) Appl. No.: 09/651,973

(22) Filed: Aug. 31, 2000

Related U.S. Application Data

(63) Continuation-in-part of application No. 09/609,679, filed on Jul. 3, 2000, now abandoned.

(51) Int. Cl.[7] ..... E02F 3/78
(52) U.S. Cl. ..... 172/815; 37/281
(58) Field of Search ..... 37/274, 280, 281, 37/105; 172/810, 811, 817, 815

(56) References Cited

U.S. PATENT DOCUMENTS 1,929,959 A * 10/1933 Soule ..... 37/44
2,332,712 A * 10/1943 Gustafson et al. ..... 37/42
2,594,727 A * 4/1952 Burggren ..... 37/143
3,055,126 A * 9/1962 Emhof ..... 37/42
3,208,166 A * 9/1965 Proulx ..... 37/42
3,373,515 A * 3/1968 Schneider ..... 37/50
3,651,587 A * 3/1972 Plasser et al. ..... 37/105
3,657,828 A * 4/1972 Anderson ..... 37/46
4,019,268 A * 4/1977 Waterman ..... 37/10
4,068,726 A * 1/1978 Heitman ..... 172/802
4,479,312 A * 10/1984 Turgeon ..... 37/219
4,552,226 A * 11/1985 Platter ..... 172/815
4,969,280 A * 11/1990 Thorneloe ..... 37/281
5,031,343 A * 7/1991 Houle et al. ..... 37/231
6,240,660 B1 * 6/2001 Dugas ..... 37/280
6,363,631 B1 * 4/2002 Cordingley ..... 37/280

* cited by examiner

*Primary Examiner*—Thomas B. Will
*Assistant Examiner*—Kristine Markovich
(74) *Attorney, Agent, or Firm*—Dennis W. Beech

(57) ABSTRACT

The movable blade for attachment to a material moving machine is a generally rectangular blade for hinged attachment to a machine shovel, box grader blade or other similar device mounted on the machine. The movable blade angle of extension or retraction relative to the machine is controlled by a hydraulic cylinder, brace or other structural element. When the movable blade is extended outwardly at an angle relative to the machine the machine may be operated parallel to the material to be moved. This action relative to material positioned next to a ditch allows the operator to fill the ditch with material in a continuous operation along the ditch rather than requiring short movements at an angle to the ditch to move the material. The movable blade may also have a rotational mechanism to raise and lower the extension end for use in slope grading adjacent a roadway as an example.

8 Claims, 3 Drawing Sheets

MOVABLE BLADE FOR MATERIAL MOVING MACHINES

This is a continuation-in-part of application Ser. No. 09/609,679 filed Jul. 3, 2000 now abandoned.

BACKGROUND OF THE INVENTION

1. Field of the Invention

This invention relates to machines that move or push material such as dirt, asphalt and the like. The new device is a side attachment blade for deployment beyond the width of the vehicle wheels to move material adjacent to the machine.

2. Description of Related Art

Various extension blades or wings have been disclosed in related art for use with bulldozers, snow plows, road graders and the like. Most of these devices are designed to either extend the length of the plow blade as in U.S. Pat. No. 5,848,654, issued May 18, 1999 or to retain material being pushed or plowed within the blade as for example in U.S. Pat. No. 5,903,986. In these applications the wing is either in the plane of the machine blade or is angled forward therefrom.

Other devices for material moving machines include use of machine blade extension which rotate rearward of the machine primary blade to move material away from a road edge. Such devices are typified by U.S. Pat. No. 3,241,254, issued Jan. 17, 1964. In this disclosure a wing member is pivotally attached to the end of a motor grader primary blade. The structure pushes snow that has been moved by a leading snow plow further away from a roadway edge. The mounting and operational structure is quite complex for the application and is limited to motor grader type machines.

The present invention defines a simple attachment and control apparatus for a side attachment blade to be used with bulldozers, tractors, backhoes, loaders and the like. The side blade is mounted to be deployable beyond the width of the vehicle wheels.

When the side blade is angularly deployed the tractor or other machine may be operated along a road edge in a continuous manner to move material away from the side of a road or into a ditch and to grade road edge slopes. Thus the tractor is not required to make short forward and backward movements at an angle to the material to be moved to for example fill a ditch with dirt.

SUMMARY OF THE INVENTION

One object of the present invention is improved operation of material moving machines for movement of material such as dirt, asphalt, gravel and the like that is adjacent to the side of the machine. Another object is improved safety of operating a material moving machine on a roadway while pushing material off the roadway or away from the edge of the roadway. A further object is reduction of head and body movement of an operator when moving material.

In accordance with the description presented herein, other objectives of this invention will become apparent when the description and drawings are reviewed.

DESCRIPTION OF THE PREFERRED EMBODIMENT

Figure 1:
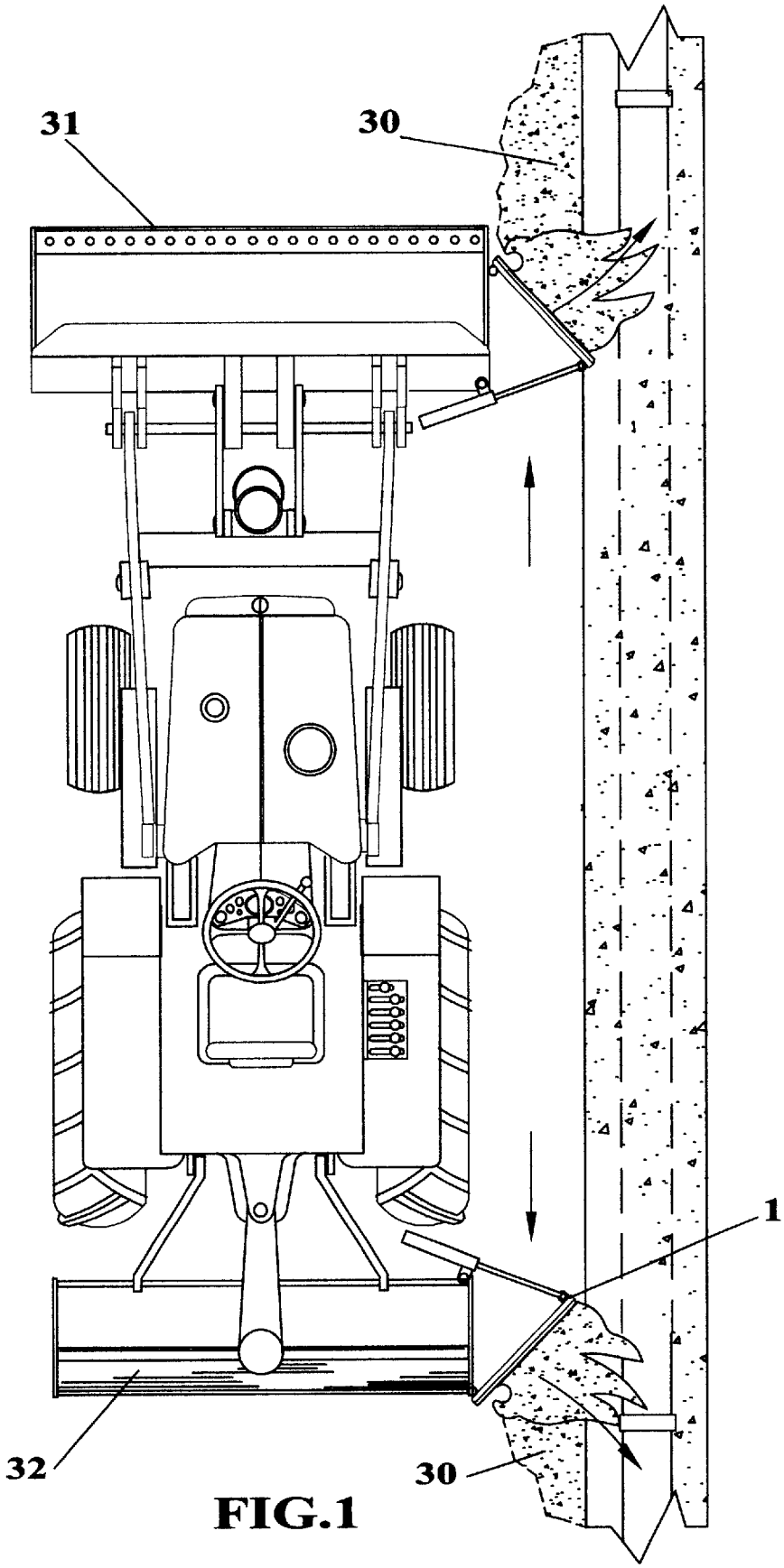
FIG. 1 illustrates a top view of a tractor with front bucket shovel and back grading box blade with a movable blade attached to each.

A generally rectangular movable blade is attached to a tractor blade, bucket, grading box blade or similar structure using a hinge or other rotational attachment device on one end of the movable blade. An extension device such as a hydraulic cylinder with piston, hand adjustable extension brace or other extending and retracting brace is located adjacent the opposite end of the movable blade. The movable blade may then be extended for use in moving material and retracted for storage when not in use. The use of the extended movable blade allows the operator to move in a continuous manner adjacent to the material (30) to be moved. The movable blade may also have a rotational mechanism for raising and lowering of the blade extension end.

Referring to FIG. 1 through 5, the movable blade (1) for moving material (30) is attached to a primary grading element such as a bucket shovel (31) or box grader (32), also known by the trade name GANNON, by a hinge (2) on rotation end (3). The movable blade (1) may then be extended away from the mounting element (33) at the extension end (4) by an angle (5), which may exceed 90 degrees.

Figure 2:
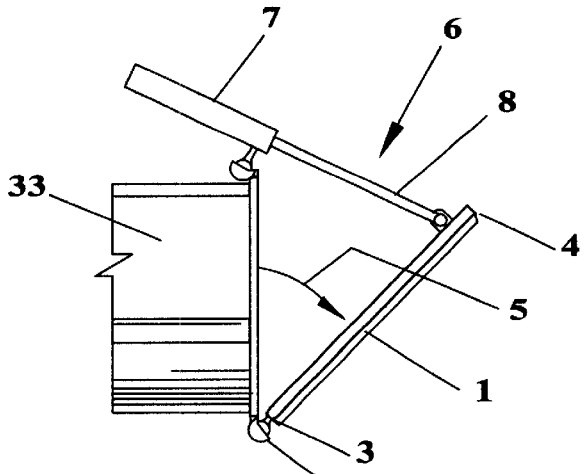
FIG. 2 illustrates a top partial view of a grading box blade with movable blade attached.
Figure 3:
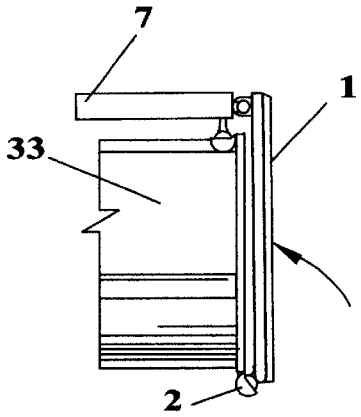
FIG. 3 illustrates a top partial view of a grading box blade with the movable blade retracted.

The extension end (4) has an extension device (6) attached intermediate the extension end (4) and the rotation end (3). The extension device (6) is also attached to the mounting element (33). The preferred embodiment is illustrated in FIGS. 2 and 3 as comprising a hydraulic cylinder (7) with piston (8). The piston (8) is rotatably attached to the movable blade (1) and the hydraulic cylinder (7) is rotatably attached to the mounting element (33). The action of the hydraulic assembly causes the movable blade (1) to extend away from the mounting element (33) to angle (5) for grading. The hydraulic controls and connections would normally be integrated with the machine to which attached.

Figure 4:
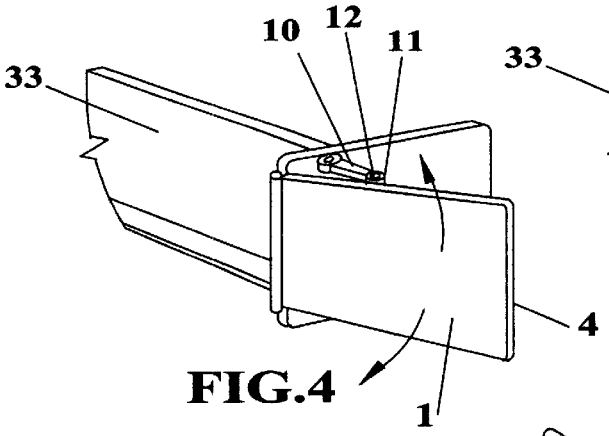
FIG. 4 illustrates a perspective view of a partial grading box blade with movable blade attached.
Figure 5:
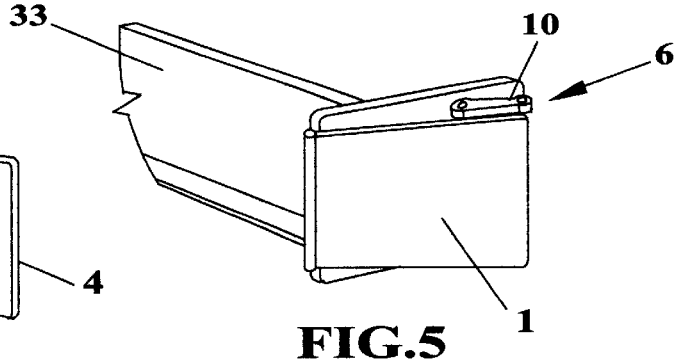
FIG. 5 illustrates a top partial view of a grading box blade with movable blade and alternate extension means.

An alternate extension device (6) is illustrated in FIGS. 4 and 5 as using a brace (10) which is rotationally attached to the movable blade (1) and mounting element (33). The brace (10) also has a rotational element intermediate the movable blade (1) and mounting element (33). When the movable blade (1) is extended the brace (10) may be held in position by for example a pin (11) inserted in apertures (12) in the two brace elements. On retracting the movable blade (1) the pin (11) may again be inserted in apertures (12) to retain the movable blade (1) in a stored position.

Figure 6:
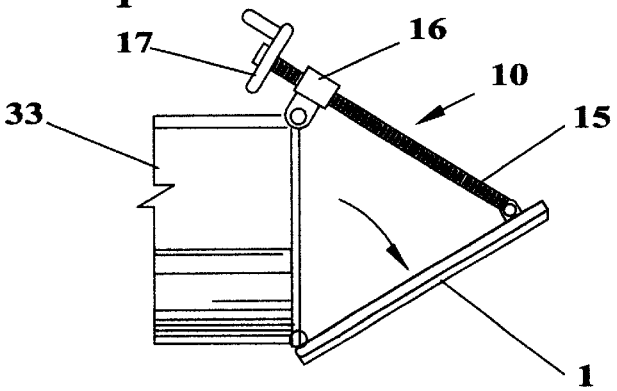
FIG. 6 illustrates a top partial view of a grading box blade with an alternate extension means.

Referring to FIG. 6 another alternate embodiment is illustrated for the extension device (6). In this case a threaded shaft (15) is threadably engaged with a sleeve (16) attached to the movable blade (1). The threaded shaft (15) is rotated by means of wheel (17) to cause the movable blade (1) to be extended and retracted through action of brace (10).

Figure 7:
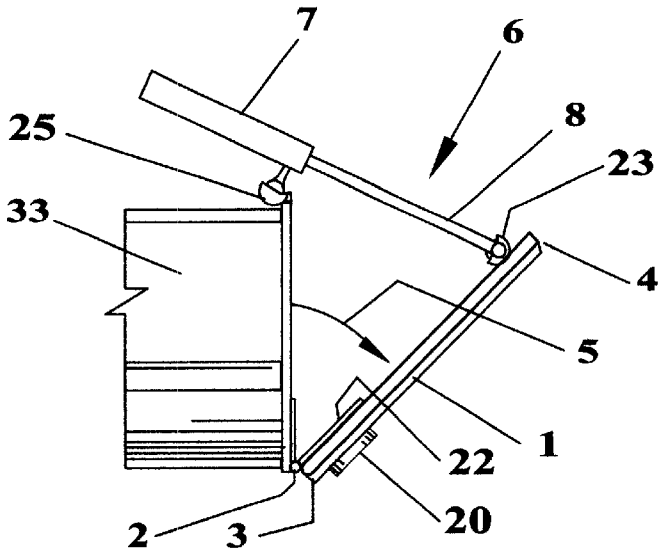
FIG. 7 illustrates a top partial view of a grading box blade with rotatable movable blade attached.
Figure 8:
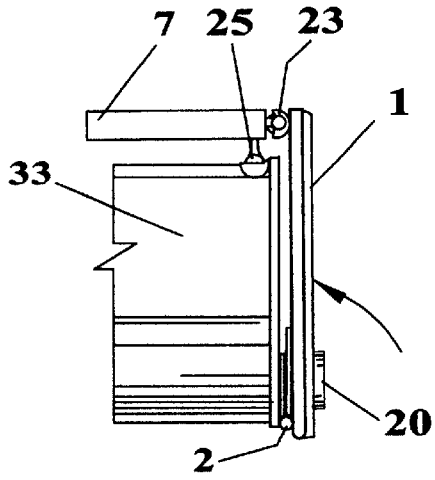
FIG. 8 illustrates a top partial view of a grading box blade with the movable blade retracted.
Figure 9:
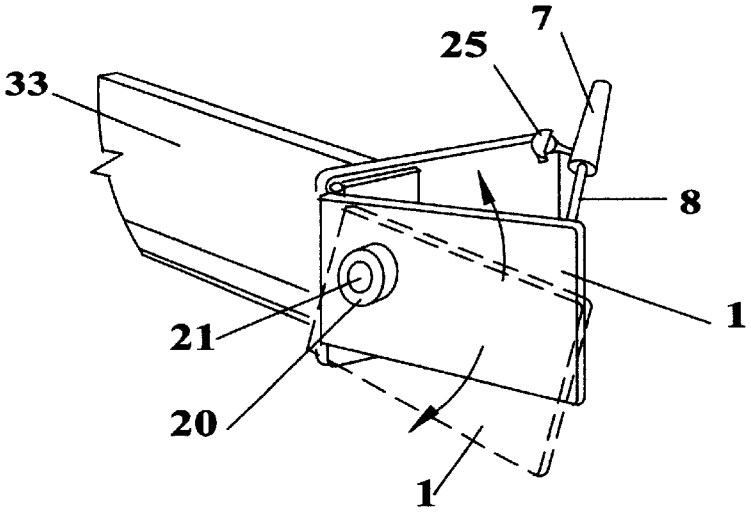
FIG. 9 illustrates a perspective elevation view of a partial grading box blade with rotatable movable blade attached.

Referring to FIGS. 7 through 9, a rotational mechanism (20) has been attached to movable blade (1). The rotational mechanism (20) has a center shaft (21) which is fixedly attached to the leaf element (22) of hinge (2). In this embodiment the movable blade (1) is extended and retracted by a hydraulic cylinder (7) and piston (8). The hydraulic cylinder (7) is attached to the mounting element (33) by a universal joint (25) and the piston (8) is attached to the movable blade (1) by a universal joint (23). This structure allows the extension device (6) to move in three dimensions when the rotational mechanism (20) is used to rotate the movable blade (1) about shaft (21) to raise and lower extension end (4). While a rotational mechanism with a shaft for rotation thereabout has been described, other mechanisms such as a pivot mechanism with hydraulic actuators may also be used.

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A device for a material moving machine having a primary grading element comprising:

a movable blade having a rotation end and an extension end;

the rotation end rotationally attached to a mounting element of a primary grading element by a hinge such that the movable blade is oriented to move material at a side of the mounting element and in approximately a same horizontal plane as the primary grading element;

an extension device attached to the movable blade and the mounting element for control of extension and retraction of the movable blade relative to the mounting element;

a rotational mechanism is attached to the movable blade;

a shaft is fixedly attached to a leaf element of the hinge; and the shaft is engaged with the rotational mechanism wherein rotational force exerted on the shaft causes the movable blade and rotational mechanism to rotate.

2. The device as in claim 1 wherein the extension device is attached at the approximate extension end.

3. The device as in claim 1 wherein the extension device is attached to the movable blade intermediate the rotation end and the extension end.

4. The device as in claim 1 wherein the movable blade having a mounting bracket to which the extension device is attached.

5. The device as in claim 1 wherein the extension device is comprised of a hydraulic cylinder and piston.

6. The device as in claim 1 wherein the extension device is a brace.

7. The device as in claim 1 wherein the attachment of the extension device to the movable blade is a universal joint and to the mounting element is a second universal joint.

8. A device for a material moving machine having a box grader attached comprising:

a movable blade having a rotation end and an extension end;

the rotation end rotationally attached to a mounting element of the box grader by a hinge such that the movable blade is oriented to move material at a side of the mounting element and in approximately a same horizontal plane as the box grader;

an extension device attached to the movable blade and the mounting element for control of extension and retraction of the movable blade relative to the mounting element;

a rotational mechanism is attached to the movable blade;

a shaft is fixedly attached to a leaf element of the hinge; and the shaft is engaged with the rotational mechanism wherein rotational force exerted on the shaft causes the movable blade and rotational mechanism to rotate.

* * * * *